US009023123B2

(12) United States Patent
O'Rear et al.

(10) Patent No.: US 9,023,123 B2
(45) Date of Patent: May 5, 2015

(54) PROCESS, METHOD, AND SYSTEM FOR REMOVING MERCURY FROM FLUIDS

(71) Applicants: Dennis John O'Rear, Petaluma, CA (US); Russell Evan Cooper, Fairfield, CA (US); Sujin Yean, Houston, TX (US); Darrell Lynn Gallup, Meridian, ID (US); Lyman Arnold Young, Oakland, CA (US)

(72) Inventors: Dennis John O'Rear, Petaluma, CA (US); Russell Evan Cooper, Fairfield, CA (US); Sujin Yean, Houston, TX (US); Darrell Lynn Gallup, Meridian, ID (US); Lyman Arnold Young, Oakland, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 188 days.

(21) Appl. No.: 13/895,850

(22) Filed: May 16, 2013

(65) Prior Publication Data

US 2013/0306312 A1 Nov. 21, 2013

Related U.S. Application Data

(60) Provisional application No. 61/647,919, filed on May 16, 2012.

(51) Int. Cl.

| | |
|---|---|
| ***C10L 3/10*** | (2006.01) |
| ***E21B 43/40*** | (2006.01) |
| ***E21B 43/34*** | (2006.01) |

(52) U.S. Cl.

CPC ..... *C10L 3/101* (2013.01); *E21B 43/34* (2013.01); *E21B 43/40* (2013.01)

(58) Field of Classification Search

CPC ..... C10L 3/101; E21B 43/40

USPC ..... 48/127.3, 127.5; 423/210

See application file for complete search history.

(56) References Cited

U.S. PATENT DOCUMENTS

| | | | |
|---|---|---|---|
| 3,083,764 | A | 4/1963 | Gaskell et al. |
| 3,873,581 | A | 3/1975 | Fitzpatrick et al. |
| 4,028,236 | A | 6/1977 | Townsend et al. |
| 4,094,098 | A | 6/1978 | Gourley |
| 4,094,777 | A | 6/1978 | Sugier et al. |
| 4,101,631 | A | 7/1978 | Ambrosini et al. |
| 4,108,769 | A | 8/1978 | Krieg et al. |
| 4,133,755 | A | 1/1979 | Tarao et al. |
| 4,149,598 | A | 4/1979 | Christian |

(Continued)

FOREIGN PATENT DOCUMENTS

WO WO 2014/039758 A2 * 3/2014 ..... C10L 3/10

OTHER PUBLICATIONS

Pending U.S. Appl. No. 12/109,194, filed Apr. 24, 2008.

(Continued)

*Primary Examiner* — Timothy Vanoy

(57) ABSTRACT

Trace levels of mercury in a natural gas are reduced by scrubbing the natural gas in an absorber with an aqueous solution comprising a water-soluble sulfur compound. The water-soluble sulfur compound reacts with a least a portion of the mercury in the natural gas to produce a treated natural gas with a reduced concentration of mercury, and a mercury containing sulfur-depleted solution which can be disposed by injection into a (depleted) underground formation. The produced water extracted with the natural gas from the underground formation can be recycled for use as the scrubbing solution. In one embodiment, a fresh source of water-soluble sulfur compound as feed to the absorber can be generated on-site by reacting an elemental sulfur source with a sulfur reagent in produced water.

25 Claims, 1 Drawing Sheet

(56) References Cited

U.S. PATENT DOCUMENTS

| | | | | |
|---|---|---|---|---|
| 4,151,077 | A | 4/1979 | Nogueira et al. | |
| 4,167,481 | A | 9/1979 | Cremers et al. | |
| 4,230,486 | A | 10/1980 | Capuano et al. | |
| 4,336,237 | A | 6/1982 | Kudryk et al. | |
| 4,338,288 | A | 7/1982 | Rollmann | |
| 4,354,942 | A | 10/1982 | Kaczur et al. | |
| 4,551,237 | A | 11/1985 | Fenton | |
| 4,578,195 | A | 3/1986 | Moore et al. | |
| 4,619,744 | A | 10/1986 | Horton | |
| 4,678,584 | A | 7/1987 | Elfline | |
| 4,708,853 | A | 11/1987 | Matviya et al. | |
| 4,709,118 | A | 11/1987 | Yan | |
| 4,752,397 | A | 6/1988 | Sood | |
| 4,876,025 | A | 10/1989 | Roydhouse | |
| 4,877,515 | A | 10/1989 | Audeh | |
| 4,880,527 | A | 11/1989 | Audeh | |
| 4,902,662 | A | 2/1990 | Toulhoat et al. | |
| 4,915,818 | A | 4/1990 | Yan | |
| 4,981,577 | A | 1/1991 | Audeh et al. | |
| 4,985,389 | A | 1/1991 | Audeh | |
| 5,034,203 | A | 7/1991 | Audeh et al. | |
| 5,037,552 | A | 8/1991 | Furuta et al. | |
| 5,107,060 | A | 4/1992 | Yan | |
| 5,110,480 | A | 5/1992 | Yan | |
| 5,173,286 | A | 12/1992 | Audeh | |
| 5,202,301 | A | 4/1993 | McNamara | |
| 5,238,488 | A | 8/1993 | Wilhelm | |
| 5,248,488 | A | 9/1993 | Yan | |
| 5,304,693 | A | 4/1994 | Boitiaux et al. | |
| 5,336,835 | A | 8/1994 | McNamara | |
| 5,360,632 | A | 11/1994 | Johnson et al. | |
| 5,407,009 | A | 4/1995 | Butler et al. | |
| 5,961,821 | A | 10/1999 | Varadaraj et al. | |
| 6,268,543 | B1 | 7/2001 | Sakai et al. | |
| 6,350,372 | B1 | 2/2002 | Degnan et al. | |
| 6,403,044 | B1 | 6/2002 | Litz et al. | |
| 6,475,451 | B1 * | 11/2002 | Leppin et al. | 423/210 |
| 6,521,131 | B1 | 2/2003 | Hamilton et al. | |
| 6,685,824 | B2 | 2/2004 | Frankiewicz et al. | |
| 6,866,048 | B2 | 3/2005 | Mattox | |
| 6,906,398 | B2 | 6/2005 | Yeo et al. | |
| 6,960,291 | B2 | 11/2005 | Greaney et al. | |
| 7,037,474 | B2 | 5/2006 | Nolan et al. | |
| 7,093,655 | B2 | 8/2006 | Atkinson | |
| 7,591,944 | B2 | 9/2009 | Carnell et al. | |
| 7,666,318 | B1 | 2/2010 | Lehtinen et al. | |
| 7,744,763 | B2 | 6/2010 | Cross et al. | |
| 7,771,700 | B2 * | 8/2010 | Mauldin et al. | 423/566.3 |
| 7,775,278 | B2 | 8/2010 | Willberg et al. | |
| 2005/0263739 | A1 | 12/2005 | Mattox et al. | |
| 2006/0048646 | A1 | 3/2006 | Olson et al. | |
| 2007/0246426 | A1 | 10/2007 | Collins | |
| 2008/0041227 | A1 | 2/2008 | Mulvaney, III et al. | |
| 2008/0196892 | A1 | 8/2008 | Lau et al. | |
| 2008/0283470 | A1 | 11/2008 | Gustafsson et al. | |
| 2009/0114247 | A1 | 5/2009 | Brown et al. | |
| 2009/0261040 | A1 | 10/2009 | Pruet | |
| 2009/0288825 | A1 | 11/2009 | Tang | |
| 2009/0304563 | A1 | 12/2009 | Harada et al. | |
| 2009/0308609 | A1 | 12/2009 | Curole et al. | |
| 2010/0000910 | A1 | 1/2010 | Gallup et al. | |
| 2010/0025184 | A1 | 2/2010 | Shibuya et al. | |
| 2010/0032344 | A1 | 2/2010 | Cross et al. | |
| 2010/0032345 | A1 | 2/2010 | Cross et al. | |
| 2010/0078358 | A1 | 4/2010 | Tullos et al. | |
| 2010/0099596 | A1 | 4/2010 | Trahan | |
| 2010/0126909 | A1 | 5/2010 | Bhasin et al. | |
| 2010/0147742 | A1 | 6/2010 | Ozum | |
| 2010/0155330 | A1 | 6/2010 | Burba et al. | |
| 2010/0175896 | A1 | 7/2010 | Owen | |
| 2010/0200477 | A1 | 8/2010 | Varadi et al. | |
| 2010/0320124 | A1 | 12/2010 | Zhang et al. | |
| 2011/0163008 | A1 | 7/2011 | Zhang et al. | |
| 2011/0226700 | A1 * | 9/2011 | Hetherington et al. | 210/688 |
| 2011/0253375 | A1 | 10/2011 | Jamaluddin et al. | |
| 2012/0073811 | A1 | 3/2012 | Mock | |
| 2013/0202503 | A1 * | 8/2013 | Simonetti et al. | 423/210 |

OTHER PUBLICATIONS

Pending U.S. Appl. No. 12/132,475, filed Jun. 3, 2008.
Pending U.S. Appl. No. 12/167,466, filed Jul. 3, 2008.
Pending U.S. Appl. No. 12/883,578, filed Sep. 16, 2010.
Pending U.S. Appl. No. 12/883,921, filed Sep. 16, 2010.
Pending U.S. Appl. No. 12/883,971, filed Sep. 16, 2010.
Pending U.S. Appl. No. 12/883,995, filed Sep. 16, 2010.
Pending U.S. Appl. No. 12/950,060, filed Nov. 19, 2010.
Pending U.S. Appl. No. 12/950,170, filed Nov. 19, 2010.
Pending U.S. Appl. No. 12/950,637, filed Nov. 19, 2010.
Pending U.S. Appl. No. 13/299,436, filed Nov. 16, 2011.
Pending U.S. Appl. No. 13/804,172, filed Mar. 14, 2013.
Pending U.S. Appl. No. 13/804,430, filed Mar. 14, 2013.
Pending U.S. Appl. No. 13/804,662, filed Mar. 14, 2013.
Pending U.S. Appl. No. 13/826,213, filed Mar. 14, 2013.
Pending U.S. Appl. No. 13/895,612, filed May 16, 2013.
Pending U.S. Appl. No. 13/895,754, filed May 16, 2013.
Pending U.S. Appl. No. 13/895,983, filed May 16, 2013.
Pending U.S. Appl. No. 13/896,242, filed May 16, 2013.
Pending U.S. Appl. No. 13/896,255, filed May 16, 2013.

Ashworth, S. C., "Mercury Removal at Idaho National Engineering and Environmentally Laboratory's New Wastle Calciner Facility," *Waste Management*, Feb. 27-Mar. 2, 2000, INEEL, Bechtel BWXT Idaho, LLC, Tucson, AZ, pp. 1-20.

Campanella et al., "Mercury Removal from Petrochemical Wastes," *Water Research*, 1986, vol. 20, No. 1, pp. 63-65.

Carnell et al., "Mercury Matters," *Hydrocarbon Engineering*, Dec. 2005, 3 pages.

Chaiyasit et al., "Decontamination of Mercury Contaminated Steel (API 5L-X52) Using Iodine and Iodide Lixiviant," *Modern Applied Science*, Jan. 2010, vol. 4, No. 1, pp. 12-20.

Clever et al., "The Solubility of Mercury and Some Sparingly Soluble Mercury Salts in Water and Aqueous Electrolyte Solutions," *Journal of Physical and Chemical Reference Data*, 1895, vol. 14, No. 3, pp. 631-680.

Corvini et al., "Mercury Removal from Natural Gas and Liquid Streams," *UOP LLC*, 2002, Houston, TX, pp. 1-9.

Findlay et al., "Removal of Elemental Mercury from Wastewaters Using Polysulfides," *Environmental Science and Technology*, Nov. 1981, vol. 15, No. 11, pp. 1388-1390.

Gildert et al., "Mercury Removal from Liquid Hydrocarbons in Ethylene Plants," *AIChE Paper No. 135c*, Mar. 24, 2010, Spring National Meeting, San Antonio, TX, 14 pages.

Kim et al., "Demulsification of Water-In-Crude Oil Emulsions by a Continuous Electrostatic Dehydrator," *Separation Science and Technology*, 2002, vol. 37, No. 6, pp. 1307-1320.

Larson et al., "Mass-Transfer Model of Mercury Removal from Water via Microemulsion Liquid Membranes," *Industrial & Engineering Chemistry Research*, 1994, vol. 33, No. 6, pp. 1612-1619.

Lemos et al., "Demusification of Water-in-Crude Oil Emulsions Using Ionic Liquids and Microwave Irradiation," *Energy Fuels*, 2010, vol. 24, pp. 4439-4444.

Morel et al., "The Chemical Cycle and Bioaccumulation of Mercury," *Annual Review Ecology, Evolution, and Systematics*, 1998, vol. 29, pp. 543-566.

Núñez et al., "Leaching of Cinnabar with HCI-Thiourea Solutions as the Basis of a Process for Mercury Obtention," *Metallurgical Transactions B*, Sep. 1996, vol. 17B, pp. 443-448.

Sharma et al., "Chemical Demulsification ofNatural Petroleum Emulsions of Assam (India)," *Colloid & Polymer Science*, 1982, vol. 260, pp. 616-622.

Sizeneva et al., "Applied Electrochemistry and Corrosion Protection of Metals: Mercury Passivation Solutions of Potassium Chloride and Sodium Hydroxide and Hypochlorite," *Russisan Journal of Applied Chemistry*, 2009, vol. 82, No. 1, pp. 52-56.-

(56) References Cited

OTHER PUBLICATIONS

Sizeneva et al., "Inorganic Synthesis and Indusrial Inorganic Chemistry: A Study of Mercury Dissolution in Aqueous Solutions of Sodium Hypochlorite," *Russian Journal of Applied Chemistry*, 2005, vol. 78, No. 4, pp. 546-548.

Venkatesan et al., "Removal of Complexed Mercury by Dithiocarbamate Grafted on Mesoporous Silica," *Journal of Radioanalytical and Nuclear Chemistry*, 2003, vol. 256, No. 2, pp. 213-218.

Waldo, John H., "Some New Water-Soluble Organo-Mercury Compounds," *Water Soluble Organo Compounds*, Mar. 6, 1931, vol. 53, pp. 992-996.

Wasay et al., "Remediation of a Soil Polluted by Mercury with Acidic Potassium Iodide," *Journal of Hazardous Materials*, 1995, vol. 44, pp. 93-102.

Yuan et al., "Fractions and Leaching Characteristics of Mercury in Coal," *Environmental Monitoring and Assessment*, Jan. 6, 2009, vol. 167, pp. 581-586.

Zhao et al., "Removal of Elemental Mercury by Sodium Chlorite Solution," *Chemical Engineering & Technology*, 2008, vol. 31, No. 3, pp. 350-354.

International Search Report for International Application No. PCT/UYS2013/041357 dated Sep. 25, 2013, 11 pages.

* cited by examiner

PROCESS, METHOD, AND SYSTEM FOR REMOVING MERCURY FROM FLUIDS

CROSS-REFERENCE TO RELATED APPLICATIONS

This application claims benefit under 35 USC 119 of U.S. Patent Application Ser. No. 61/647,919 with a filing date of May 16, 2012. This application claims priority to and benefits from the foregoing, the disclosures of which are incorporated herein by reference.

TECHNICAL FIELD

The invention relates generally to a process, method, and system for removing mercury from hydrocarbon fluids such as natural gas.

BACKGROUND

Mercury can be present in trace amounts in all types of hydrocarbon streams such as natural gas. The amount can range from less than 1 ppbw (parts per billion by weight) to over a thousand ppbw depending on the source. Methods have been disclosed to remove mercury from liquid hydrocarbon feed. U.S. Pat. Nos. 5,281,258 and 5,223,145 disclose methods of removing mercury from natural gas streams by selective adsorption in fixed adsorbent beds. U.S. Pat. No. 4,474,896 discloses using polysulfide based absorbents to remove elemental mercury ($Hg^0$) from gaseous and liquid hydrocarbon streams.

There are also a number of commercially available processes and products for the removal of elemental mercury $Hg^0$ from hydrocarbon streams including but not limited to ICI Synetix' Merespec™ fixed bed absorbents, UOP's HgSIV™ regenerative mercury removal adsorbents, and Johnson Matthey's Puraspec™ and Puracare™ granulated absorbents for the removal of mercury from gaseous hydrocarbon streams. Adsorption technology generates a mercury-containing spent adsorbent, which is hazardous solid waste for disposal.

Production of oil and gas is usually accompanied by the production of water. The produced water may consist of formation water (water present naturally in the reservoir), or water previously injected into the formation. As exploited reservoirs mature, the quantity of water produced increases. Produced water is the largest single fluid stream in exploration and production operations. Every day, U.S. oil and gas producers bring to the surface 60 million barrels of produced water.

There is a need for improved methods for the removal of mercury from gaseous hydrocarbon streams, and particularly methods wherein produced water can be used/recycled.

SUMMARY OF THE INVENTION

In one aspect, the invention relates to an improved method to treat a crude oil to reduce its mercury concentration. The method comprises: recovering a mixture of produced water and mercury-containing natural gas from an underground reservoir; separating the mercury-containing natural gas from the produced water; scrubbing the natural gas with an aqueous solution in an absorber, wherein the aqueous solution comprises a water-soluble sulfur compound to react a least a portion of the mercury in the natural gas with the water-soluble sulfur compound to produce a treated natural gas with a reduced concentration of mercury and a mercury containing sulfur-depleted solution; removing at least a portion of the mercury containing sulfur-depleted solution as a purge stream; recirculating at least a portion of the mercury containing sulfur-depleted solution as a recirculating stream; and providing a fresh source of water-soluble sulfur compound as a feed to the absorber for reaction with the mercury in the natural gas.

In one embodiment, the fresh source of water-soluble sulfur compound is generated on-site by reacting .elemental sulfur with a sulfidic solution. In another embodiment, at least a portion of the purge stream is disposed by injection into an underground reservoir.

DETAILED DESCRIPTION

Figure 1:
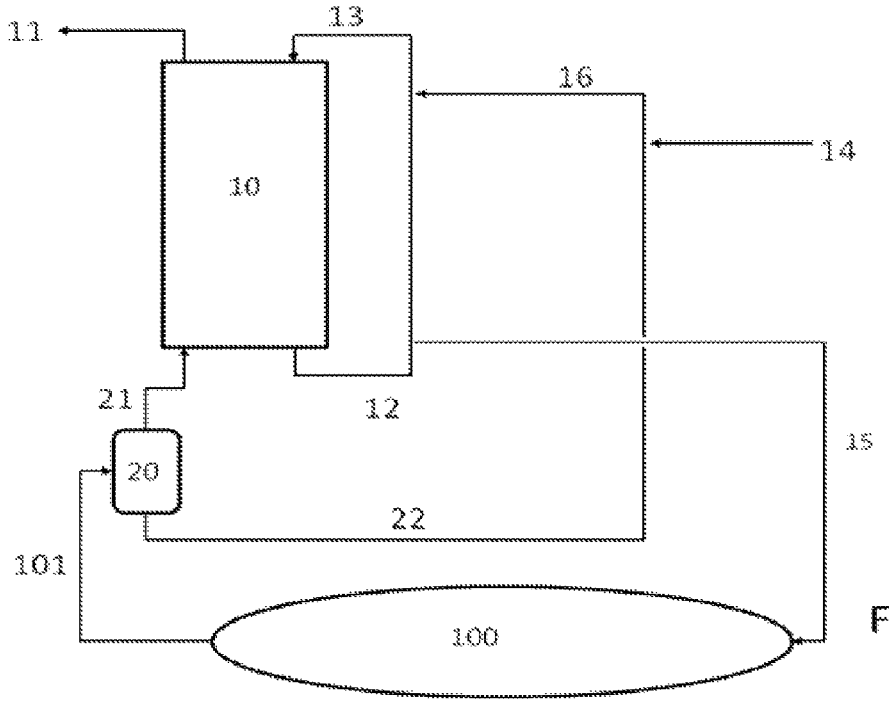
FIG. 1 is a block diagram of an embodiment of a system and process to remove mercury from natural gas, wherein the scrubbing liquid needed for the mercury removal unit (MRU) contains produced water, and wastewater from the system is disposed by injection into an underground reservoir.

The following terms will be used throughout the specification and will have the following meanings unless otherwise indicated.

"Trace amount" refers to the amount of mercury in the natural gas. The amount varies depending on the natural gas source, ranging from a few $\mu g/Nm^3$ to up to 30,000 $\mu g/Nm^3$.

"Mercury sulfide" may be used interchangeably with HgS, referring to mercurous sulfide, mercuric sulfide, and mixtures thereof. Normally, mercury sulfide is present as mercuric sulfide with a stoichiometric equivalent of one mole of sulfide ion per mole of mercury ion.

"Flow-back water" refers to water that flows back to the surface after being placed into a subterranean formation as part of an enhanced oil recovery operation, e.g., water flooding or a hydraulic fracturing operation.

"Produced fluids" refers hydrocarbon gases and/or crude oil. Produced fluids may be used interchangeably with hydrocarbons.

"Produced water" refers to the water generated in the production of oil and gas, including formation water (water present naturally in a reservoir), as well as water previously injected into a formation either by matrix or fracture injection, which can be any of connate water, aquifer water, seawater, desalinated water, flow-back water, industrial by-product water, and combinations thereof.

"Polysulfide" refers generally to an aqueous solution that contains polysulfide anions represented by the formula $S_x^{2-}$. Polysulfide solutions can be made by dissolving in water reagents including cations from alkali metals, alkali earth, ammonia, hydrogen, and combinations thereof, or by reacting elemental sulfur with sulfidic solutions.

"Sulfur-depleted" means that at least a portion of the water-soluble sulfur compound in the solution will have reacted, forming complexes such as HgS, which may be present in the solution either dissolved or in suspension. The sulfur associated with the complexes is not a water-soluble sulfur compound for purposes of defining sulfur depleted.

"Absorber" may used interchangeably with "scrubber," referring to a device to contact a gas and a liquid, permitting transfer of some molecules from the gas phase to the liquid phase. Examples include but are not limited to absorption columns, fiber film contactors, etc.

The invention relates to systems and processes for the removal of mercury from a natural gas. The system in one embodiment is located at a natural gas production facility, wherein produced water is used in the mercury removal process prior to the liquefaction of the natural gas for transport. The wastewater containing mercury after the removal process can be injected into an underground facility, e.g., a reservoir. In one embodiment, the reagents needed for the mercury removal is generated on-site, e.g., manufacture of polysulfide solutions from elemental sulfur and sulfidic solutions, or the manufacture of sodium sulfide solutions from sodium carbonate and sulfur sources if available on site.

Mercury Containing Natural Gas Feedstream:

Generally, natural gas streams comprise low molecular weight hydrocarbons such as methane, ethane, propane, other paraffinic hydrocarbons that are typically gases at room temperature, etc. Mercury can be present in natural gas as elemental mercury $Hg^0$, in levels ranging from about 0.01 $\mu g/Nm^3$ to 5000 $\mu g/Nm^3$. The mercury content may be measured by various conventional analytical techniques known in the art, including but not limited to cold vapor atomic absorption spectroscopy (CV-AAS), inductively coupled plasma atomic emission spectroscopy (ICP-AES), X-ray fluorescence, or neutron activation.

Method for Removing Mercury:

Mercury in natural gas is removed by treatment in a scrubber (absorber) with a solution containing an oxidant capable of oxidizing mercury but not the natural gas itself. In one embodiment, the oxidant is a water-soluble sulfur species, e.g., sulfides, hydrosulfides, and polysulfides, for extracting mercury in natural gas into the aqueous phase as soluble mercury sulfur compounds (e.g. $HgS_2^{2-}$), wherein very little or no solid mercury complex, e.g., HgS, is formed. Very little or no solid mercury complex means than less than 1% of the mercury in the crude oil after extraction is in the form of a solid such as HgS in one embodiment; less than 0.10% HgS is formed in a second embodiment; and less than 0.05% HgS in a third embodiment. The percent of solid mercury complexes can be determined by filtration, e.g., through a 0.45 micron (or less) filter.

Examples of water-soluble sulfur compounds include sodium hydrosulfide, potassium hydrosulfide, ammonium hydrosulfide, sodium sulfide, potassium sulfide, calcium sulfide, magnesium sulfide, ammonium sulfide, and mixtures thereof. Aqueous source containing water-soluble sulfur species can be any of sulfidic water, sulfidic waste water, kraft caustic liquor, kraft carbonate liquor, etc.

In one embodiment, the water-soluble sulfur species is an inorganic polysulfide such as sodium polysulfide, for an extraction of mercury from the natural gas according to equation: $Hg(g)+Na_2S_x(aq)\text{->}HgS(aq)+Na_2S_{x-1}(aq)$, where (g) denotes the mercury in the gas phase and (aq) denotes a species in water.

The removal of mercury from the natural gas can be carried out in equipment known in the art, e.g., scrubbers or absorbers (absorption columns) packed with structural packing, although a bubble cup or sieve tray could also be employed. Exemplary equipment is as described in Air Pollution Training Institute APTI 415, Control of Gaseous Emissions Chapter 5—Absorption, March 2012, the relevant disclosure is included herein by reference. In another embodiment, the absorption is via the use of fiber film contactors as described in US Patent Publication Nos. US20100200477, US20100320124, US20110163008, US20100122950, and US20110142747; and U.S. Pat. Nos. 7,326,333 and 7,381,309, which the relevant disclosures are included herein by reference.

By absorption with a scrubbing liquid containing water-soluble sulfur compounds, mercury is extracted from the natural gas feed into the liquid phase, for a treated gas stream having a reduced mercury concentration of less than 50% of the mercury originally present in one embodiment (at least 50% mercury removal); less than 10% of the original mercury level in a second embodiment (at least 90% removal); and less than 5% of the original level in a third embodiment (at least 95% removal). The mercury content in the treated natural gas will depend on the mercury content of the feed and the percent removal. The mercury content is reduced to below 10 $\mu g/Nm^3$ in one embodiment, less than 1 $\mu g/Nm^3$ in a second embodiment, and less than 0.1 $\mu g/Nm^3$ in a third embodiment.

The water for use as scrubbing liquid is non-potable water, which can be supplied at cold, heated, or ambient temperature. Depending on the location of the natural gas processing facility, the non-potable water can be any of connate water, aquifer water, seawater, desalinated water, oil fields produced water, industrial by-product water, and combinations thereof. In one embodiment, the water stream consists essentially of produced water. The water for use as the scrubbing liquid can be the produced water from the reservoir producing the natural gas. In this embodiment, a mixture of natural gas and water from an underground reservoir is first separated generating a stream of natural gas to be treated for removal of mercury, and a stream of produced water which can be use for the scrubbing liquid.

In another embodiment for a reservoir that produces dry gas only or with very little water in the produced fluid extracted from the production well, the water for use as the scrubbing liquid can be from a water storage/treatment facility connected to the natural gas processing facility, wherein produced water, seawater, etc., is recovered and prepared with the addition of water-soluble sulfur compounds to generate a scrubbing solution for mercury removal.

The amount of water-soluble sulfur compounds needed is determined by the effectiveness of sulfur compound employed. The amount of sulfur used is at least equal to the amount of mercury in the crude on a molar basis (1:1), if not in an excess amount. In one embodiment, the molar ratio ranges from 5:1 to 10,000:1. In another embodiment, from 10:1 to 5000:1. In yet another embodiment, a molar ratio of sulfur additive to mercury ranging from 50:1 to 2500:1. A sufficient amount of the sulfur compound is added to the scrubbing liquid for a sulfide concentration ranging from 0.05 M to 10M in one embodiment; from 0.1M to 5M in a second embodiment; from 0.3M to 4M in a third embodiment; and at least 0.5M in a fourth embodiment. The concentration of sulfur in the scrubbing water ranges from 50 to 200,000 ppmw in one embodiment, and from 100 to 100,000 ppmw in a second embodiment; and from 100 to 50,000 ppmw in a third embodiment. The amount of scrubbing solution provided to the absorber in one embodiment is sufficient to wet the packings and distribute the sulfur compounds for reaction with the mercury.

The pH of the water stream containing the sulfur compound is adjusted to a pre-selected pH prior to the absorber to at least 8 in one embodiment; at least 9 in a second embodiment; at least 10 in a third embodiment; and at least 11 in a fourth embodiment. The pH can be adjusted with the addition of amines such as monoethanol amine, ammonia, diethanol amine, or a strong base such as sodium hydroxide, potassium hydroxide, etc.

The scrubber is operated at a temperature of at least 50° C. in a second embodiment, and in the range of 20-90° C. in a third embodiment. The operating temperature is as high as practical in one embodiment, as HgS precipitation can be enhanced by increasing the temperature of the scrubbing solution. The operating pressure is sufficient to prevent the scrubbing solution from boiling in one embodiment, and in the range of 100 to 7000 kPa in a second embodiment. The scrubber in one embodiment is first purged with an inert gas to remove oxygen, preventing oxidation of the sulfur species. Depending on the equipment employed for the scrubbing operation and the packing materials used, the superficial gas velocity is less than 5 cm/s in one embodiment, and in the range of 2-30 cm/s in a second embodiment.

In one embodiment of the operation of the absorber column, recirculation pumps are used to recirculate the scrubbing liquid from the chamber of the absorber (bottom outlet) into spray headers located in an upper portion of the column for spraying into the gas flowing upwards in the column. The effluent stream exiting the column contains mercury extracted from the natural gas in various form, e.g., precipitates and/or water-soluble mercury compounds. A portion of the mercury-containing sulfur depleted scrubbing liquid is withdrawn on a continuous or intermittent basis as a purge stream for subsequent treatment/disposal. The rest of the scrubbing liquid is recirculated back to the absorber column as a recirculating stream. The ratio of the purge stream to the recirculating stream in one embodiment is sufficient to prevent solid HgS from precipitating in the mercury-containing sulfur-depleted scrubbing liquid.

A fresh source of sulfur compound is provided to the column on a continuous basis as a make-up source of sulfur, which can be added to the absorber as a separate make-up stream, or directly to the recirculating stream. In one embodiment, the make-up source of sulfur comprises a sulfide containing salt, e.g., sodium sulfide, which is added to the recirculating stream. The amount of make-up stream is sufficient to provide the sulfur needed for the removal of mercury from the natural gas, replacing the sulfur that is removed with the purge stream.

In one embodiment, the make-up stream containing the fresh source of water-soluble sulfur species can be generated on-site as part of the mercury removal unit. In one embodiment, polysulfide is synthesized by dissolving elemental sulfur in a sulfidic solution, e.g., a sulfide reagent such as $Na_2S$, generating $Na2S_x$ for the make-up stream. The reactor for the generation of the polysulfide can be at a temperature higher than the temperature of the absorber column, e.g., at least 10° C. higher, generating polysulfide at a higher temperature for greater dissolution of the sulfide in the scrubbing solution.

The water for use in the make-up stream can be produced water from the formation, after separation from the produced fluid such as natural gas and/crude oil in the mixture extracted from the production well.

After the scrubbing tower, the natural gas is optionally fed into a dehydrator for water removal. The dried natural gas with reduced mercury concentration can be fed to heat exchangers and other additional equipment necessary, for liquefying the gas prior to transporting. In another embodiment, the treated gas is directed to a fabric filter or an electrostatic precipitator (ESP) for removal of any particulates from the treated gas prior to liquefaction.

In one embodiment, at least a portion of the purge stream containing mercury is disposed by injection underground, e.g., into a depleted reservoir. In another embodiment, the purge stream containing mercury can be first treated before recycling or disposal according to safe environmental practices.

The mercury removal unit and process described herein may be placed in the same location of a production facility, i.e., subterranean hydrocarbon producing well, or placed as close as possible to the location of the well. In another embodiment, the mercury removal equipment is placed on a floating production, storage and offloading (FPSO) unit. A FPSO is a floating vessel for the processing of hydrocarbons and for storage of oil. The FPSO unit processes an incoming stream of crude oil, water, gas, and sediment, and produce a shippable product with acceptable properties including levels of heavy metals such as mercury, vapor pressure, basic sediment & water (BS&W) values, etc.

Figures Illustrating Embodiments:

Reference will be made to the figures with block diagrams schematically illustrating different embodiments of a mercury removal unit (MRU) and process for the removal of mercury from natural gas.

As illustrated in FIG. 1, a mixture 101 of produced water and mercury containing natural is extracted from an underground reservoir 100. The mixture is separated in a gas-water separator 20 to recover a mercury-containing gas 21 and produced water 22. The mercury-containing gas is processed in absorber 10, where it flows upwards in contact with a scrubbing liquid 13 containing a water soluble sulfur compound, e.g., a polysulfide-containing solution which flows downwards. In the column, at least a portion of the mercury in the mercury-containing gas is transferred to the scrubbing solution, generating a treated gas 11 with reduced mercury levels along with a mercury-containing sulfur-depleted scrubbing solution 12.

A portion of the mercury-containing sulfur-depleted scrubbing solution is withdrawn as a purge stream 15, and disposed by injection into the underground formation 100. As shown, the produced water 22 is used as the scrubbing liquid for the removal of mercury. Produced water 22 is mixed with a concentrated solution of polysulfur species 14 for a makeup stream which is blended with the mercury-containing sulfur-depleted polysulfide solution 12, forming the scrubbing feed 13 to the column.

It should be noted that crude oil can be produced along with natural gas as part of the produced fluid from an underground reservoir, and that not all of the produced water recovered from a reservoir (after gas/liquid separation) is needed for use in the scrubbing solution.

Figure 2:
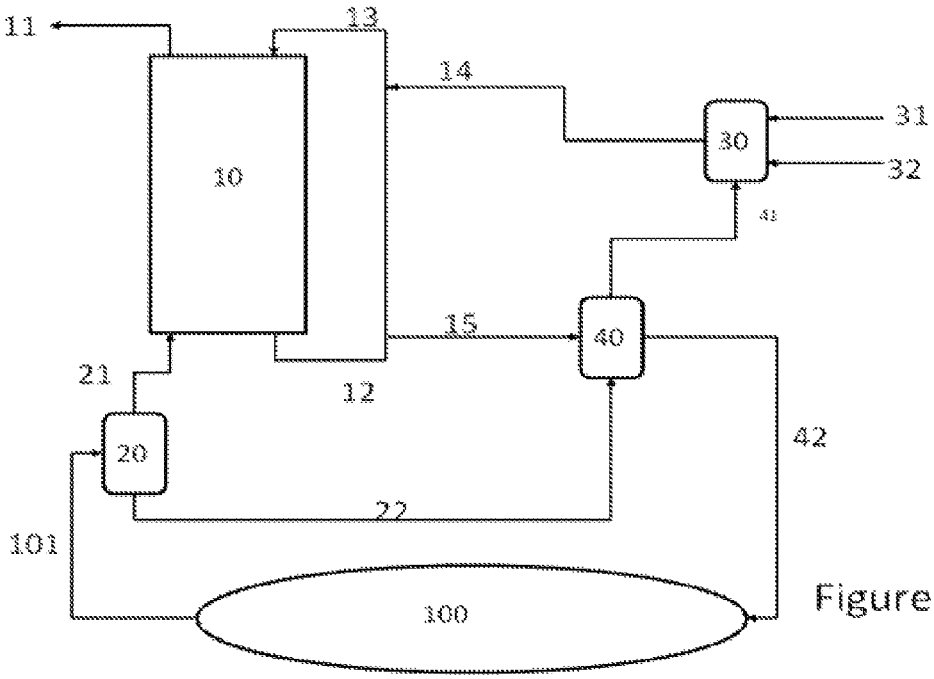
FIG. 2 is a block diagram of a second embodiment of the MRU, wherein the polysulfide needed for the mercury removal is generated on-site as part of the MRU.

FIG. 2 illustrates another embodiment of the invention, wherein the polysulfide species for the scrubbing solution is generated on-site as part of the MRU. The on-site generation can reduce operating costs by generating polysulfide from less expensive sources such as elemental sulfur and sulfide reagents. As shown, a portion of the mercury-containing sulfur depleted polysulfide solution 12 is recycled to the absorber 10, another portion is optionally recycled by injection to formation directly (not shown), and a portion 15 is sent to a filtration system 40 for the removal of any solid HgS precipitates. The mercury-containing sulfur-depleted polysulfide filtrate 41 with reduced contents of solid HgS can be used in the polysulfide synthesis reactor 30. In the reactor, elemental sulfur 32 reacts with sodium sulfide in solution 31, generating the makeup sodium polysulfide concentrate stream 14.

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

As used herein, the term "include" and its grammatical variants are intended to be non-limiting, such that recitation of items in a list is not to the exclusion of other like items that can be substituted or added to the listed items. The terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise defined, all terms, including technical and scientific terms used in the description, have the same meaning as commonly understood by one of ordinary skill in the art to which this invention belongs.

As used herein, the term "include" and its grammatical variants are intended to be non-limiting, such that recitation of items in a list is not to the exclusion of other like items that can be substituted or added to the listed items. The terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise defined, all terms, including technical and scientific terms used in the description, have the same meaning as commonly understood by one of ordinary skill in the art to which this invention belongs.

The invention claimed is:

1. A method for removing a trace amount of mercury in a natural gas feed, comprising:

recovering a mixture of produced water and mercury-containing natural gas from an underground reservoir;

separating the mercury-containing natural gas from the produced water;

scrubbing the mercury-containing natural gas with an aqueous solution in an absorber, wherein the aqueous solution comprises a water-soluble sulfur compound to react a least a portion of the mercury in the natural gas with the water-soluble sulfur compound to produce a treated natural gas with a reduced concentration of mercury and a mercury-containing sulfur-depleted solution, removing at least a portion of the mercury-containing sulfur-depleted solution as a purge stream;

recirculating at least a portion of the mercury-containing sulfur-depleted solution as a recirculating stream; and providing a fresh source of water-soluble sulfur compound as a feed to the absorber for reaction with the mercury in the natural gas.

2. The method of claim 1, further comprising injecting at least a portion of the purge stream into an underground reservoir.

3. The method of claim 1, wherein less than 1% of the mercury is scrubbed from the natural gas as a solid mercury complex.

4. The method of claim 1, wherein providing a fresh source of water-soluble sulfur compound comprises reacting elemental sulfur with a sulfidic solution.

5. The method of claim 4, wherein the sulfidic solution comprises $Na_2S$.

6. The method of claim 4, wherein the produced water separated from the mercury containing natural gas is added to the reaction of elemental sulfur with a sulfidic solution to provide a fresh source of water-soluble sulfur compound.

7. The method of claim 1, wherein the produced water separated from the mercury containing natural gas is added to the fresh source of water-soluble sulfur compound as a feed to the absorber.

8. The method of claim 1, further comprising filtering the mercury containing sulfur-depleted solution prior to recirculating at least a portion of the mercury containing sulfur-depleted solution.

9. The method of claim 8, further comprising adding the filtered mercury containing sulfur-depleted solution to a fresh source of water-soluble sulfur compound.

10. The method of claim 8, further comprising adding the filtered mercury containing sulfur-depleted solution to a reaction of elemental sulfur with a sulfidic solution to provide a fresh source of water-soluble sulfur compound as a feed to the absorber.

11. The method of claim 1, wherein the water-soluble sulfur compound is selected from sodium hydrosulfide, potassium hydrosulfide, ammonium hydrosulfide, sodium sulfide, potassium sulfide, calcium sulfide, magnesium sulfide, ammonium sulfide, and mixtures thereof.

12. The method of claim 1, wherein the aqueous solution containing a water-soluble sulfur compound comprises any of sulfidic water, sulfidic waste water, kraft caustic liquor, kraft carbonate liquor, and combinations thereof.

13. The method of claim 1, wherein at least 50% of mercury is removed from the natural gas.

14. The method of claim 13, wherein at least 90% of mercury is removed from the natural gas.

15. The method of claim 1, wherein the treated natural gas contains less than 10 $\mu g/Nm^3$ mercury.

16. The method of claim 15, wherein the treated natural gas contains less than 1 $\mu g/Nm^3$ mercury.

17. The method of claim 16, wherein the treated natural gas contains less than 0.1 $\mu g/Nm^3$ mercury.

18. The method of claim 1, wherein the aqueous solution comprising a water-soluble sulfur compound has a pH of at least 8.

19. The method of claim 1, wherein the mercury-containing natural gas is scrubbed with an aqueous solution comprising a water-soluble sulfur compound in a molar ratio of 5:1 to 10,000:1 of sulfur to mercury in the natural gas.

20. The method of claim 1, wherein the mercury-containing natural gas is scrubbed with an aqueous solution comprising a water-soluble sulfur compound having a concentration of sulfur in the aqueous solution from 50 to 20,000 ppmw.

21. The method of claim 1, wherein the method is carried out on a floating production, storage and offloading (FPSO) unit.

22. A method for removing a trace amount of mercury in a natural gas feed, comprising:

recovering a mercury-containing natural gas from an underground reservoir;

scrubbing the mercury-containing natural gas with an aqueous solution in an absorber, wherein the aqueous solution comprises a water-soluble sulfur compound to react a least a portion of the mercury in the natural gas with the water-soluble sulfur compound to produce a treated natural gas with a reduced concentration of mercury and a mercury-containing sulfur-depleted solution, removing at least a portion of the mercury containing sulfur-depleted solution as a purge stream;

recirculating at least a portion of the mercury containing sulfur-depleted solution as a recirculating stream; and providing a fresh source of water-soluble sulfur compound as a feed to the absorber for reaction with the mercury in the natural gas.

23. The method of claim 22, wherein the aqueous solution is non-potable water selected from connate water, aquifer water, seawater, desalinated water, oil field produced water, industrial by-product water, and combinations thereof.

24. The method of claim 22, wherein providing a fresh source of water-soluble sulfur compound comprises reacting elemental sulfur with a sulfidic solution.

25. The method of claim 22, wherein providing a fresh source of water-soluble sulfur compound comprises adding elemental sulfur and a sulfidic solution to the recirculating stream.

* * * * *